US010047583B2

(12) United States Patent
Wright et al.

(10) Patent No.: US 10,047,583 B2
(45) Date of Patent: Aug. 14, 2018

(54) EXPLOSIVE TUBULAR CUTTER AND DEVICES USABLE THEREWITH

(71) Applicants: David C. Wright, Spring, TX (US); John J. Kenny, Lake Charles, LA (US); David Siggers, Camden, AR (US)

(72) Inventors: David C. Wright, Spring, TX (US); John J. Kenny, Lake Charles, LA (US); David Siggers, Camden, AR (US)

(73) Assignee: WRIGHT'S WELL CONTROL SERVICES, LLC, The Woodlands, TX (US)

( * ) Notice: Subject to any disclaimer, the term of this patent is extended or adjusted under 35 U.S.C. 154(b) by 0 days.

(21) Appl. No.: 15/437,332

(22) Filed: Feb. 20, 2017

(65) Prior Publication Data

US 2017/0159386 A1 Jun. 8, 2017

Related U.S. Application Data

(62) Division of application No. 14/537,817, filed on Nov. 10, 2014, now Pat. No. 9,574,416.

(51) Int. Cl.

| | |
|---|---|
| ***E21B 29/02*** | (2006.01) |
| ***E21B 43/119*** | (2006.01) |
| ***F42B 1/028*** | (2006.01) |
| ***F42C 19/02*** | (2006.01) |
| ***F42C 11/00*** | (2006.01) |

(52) U.S. Cl.

CPC ..... *E21B 29/02* (2013.01); *E21B 43/119* (2013.01); *F42B 1/028* (2013.01); *F42C 11/00* (2013.01); *F42C 19/02* (2013.01)

(58) Field of Classification Search

CPC ..... E21B 29/00; E21B 29/02; E21B 29/04; F42B 1/02; F42B 1/028; F42B 1/036

USPC ..... 89/1.15, 1.14, 1.1; 83/639.4; 102/312, 102/314, 322, 306, 307; 166/55.7

See application file for complete search history.

(56) References Cited

U.S. PATENT DOCUMENTS

| | | | | |
|---|---|---|---|---|
| 1,537,668 A | | 5/1925 | Grant | |
| 2,876,701 A | * | 3/1959 | Long | E21B 43/11855 102/272 |
| 3,013,491 A | * | 12/1961 | Poulter | E21B 43/117 102/309 |
| 3,129,663 A | * | 4/1964 | Schnepfe, Jr. | F42D 1/04 102/275.4 |

(Continued)

*Primary Examiner* — John Cooper

(57) ABSTRACT

Explosive cutter assemblies and methods include a liner having a single unitary body, and an explosive charge disposed within the liner. The explosive charge includes a continuous unitary body of explosive material having a first area disposed in association with an inner surface of the liner and a second area extending from the center of the assembly to the first area. A detonator can be used to ignite the second area of explosive material, causing propagation of a detonation to the first area, which in turn causes deformation of the liner and projection of the liner toward a target to form a cut. An adaptor sub having a detonator within can be inserted into the cutter assembly to secure the assembly together, position the detonator in association with the explosive material, and engage a conduit usable to raise and lower the cutter assembly and transmit a detonation signal.

3 Claims, 3 Drawing Sheets

(56) References Cited

U.S. PATENT DOCUMENTS 3,233,688 A * 2/1966 Bell ..... E21B 29/02 102/307
3,260,206 A * 7/1966 Beermann ..... F24C 5/02 102/261
3,285,171 A * 11/1966 Moore ..... E21B 43/11855 102/223
3,320,884 A * 5/1967 Kowalick ..... C06C 5/06 102/275.3
3,420,173 A * 1/1969 Slawinski ..... F42B 3/02 102/317
3,460,477 A * 8/1969 Heidemann ..... F42D 1/042 102/275.2
3,990,367 A * 11/1976 Smith ..... F42D 1/04 102/275.4
4,354,433 A * 10/1982 Owen ..... B26F 3/04 102/307
4,423,682 A * 1/1984 Schimmel ..... F42D 1/042 102/275.2
4,612,857 A * 9/1986 Schimmel ..... F42C 19/0819 102/202
4,657,089 A * 4/1987 Stout ..... E21B 43/117 102/318
4,724,105 A * 2/1988 Owen ..... B26F 3/04 102/307
4,759,291 A * 7/1988 Barker ..... E21B 43/116 102/202.5
4,998,477 A 3/1991 Barker
5,060,573 A 10/1991 Montgomery et al.
5,327,835 A * 7/1994 Adams ..... F42D 1/043 102/275.11
5,365,851 A * 11/1994 Shaw ..... F42D 1/04 102/275.11
5,417,162 A * 5/1995 Adams ..... F42D 1/043 102/275.11
5,571,986 A * 11/1996 Snider ..... E21B 43/1185 102/275.11
5,777,257 A 7/1998 Kenny
5,780,764 A 7/1998 Welch et al.
5,791,821 A 8/1998 Kiesler
6,016,753 A 1/2000 Glenn et al.
6,298,913 B1 10/2001 Box
6,412,388 B1 * 7/2002 Frazier ..... E21B 43/117 102/312
6,505,559 B1 * 1/2003 Joslin ..... E21B 29/02 102/307
6,644,099 B2 11/2003 Bell
6,668,726 B2 12/2003 Lussler
6,792,866 B2 * 9/2004 Grattan ..... E21B 29/02 102/306
6,851,471 B2 * 2/2005 Barlow ..... E21B 17/042 102/307
7,073,448 B2 7/2006 Bell
7,472,652 B1 * 1/2009 Scheid ..... F42B 3/00 102/314
7,661,367 B2 * 2/2010 Yang ..... F42B 3/08 102/306
8,302,523 B2 11/2012 Bell
8,561,683 B2 * 10/2013 Wood ..... E21B 29/02 166/298
9,038,713 B1 * 5/2015 Bell ..... E21B 29/02 102/310
2003/0221579 A1 * 12/2003 Grattan ..... E21B 29/02 102/306
2009/0071362 A1 * 3/2009 Scheid ..... F42B 3/00 102/322
2013/0291711 A1 * 11/2013 Mason ..... E21B 29/02 89/1.151

* cited by examiner

EXPLOSIVE TUBULAR CUTTER AND DEVICES USABLE THEREWITH

PRIORITY

This application is a divisional of and claims priority to co-pending U.S. patent application Ser. No. 14/537,817, filed 10 Nov. 2014, entitled "Explosive Tubular Cutter and Devices Usable Therewith." The entirety of the co-pending application is herein incorporated by reference.

FIELD

Embodiments usable within the scope of the present invention relate to explosive-type cutters that are usable to cut tubular members and to methods for making, assembling, and using explosive-type cutters to sever tubular members from the inside. Embodiments usable within the scope of the present invention also relate to detonator assemblies usable to detonate explosive-type cutters and perforators and to methods for making, assembling, and using the detonator assemblies to detonate explosive-type cutters and perforators.

BACKGROUND

The ability to quickly and cleanly sever tubular members, such as well casings that are deep underground, is an essential step during well maintenance and salvage operations. Typically, the industry relies on mechanical or explosive devices to perform such cutting. One type of explosive device, that is often used, is a shaped charge explosive cutter, which provides a simple, fast, and inexpensive method by which to sever pipes within a wellbore. During typical operations, shaped charge explosive cutters are lowered to a selected depth within a well, using a wireline, at which time they are detonated, producing pressure and/or molten materials that cut through the casing.

A typical shaped charge tubular cutting device contains two circular layers of explosive material, each having a truncated cone shape. Outlining the sloped side faces of the explosive circular layers are thin metal rings, called half-liners. These two components are joined together, apex-to-apex, forming a shaped charge assembly having a liner with a V-shaped cross section. The shape charge assembly is sandwiched between two end plates, typically made from steel. Lastly, the six elements (two layers of explosive, two half-liners, and two end plates) are aligned coaxially and enclosed within a cylindrical housing, in the recited order.

The end plates contain an opening along the central axis to provide a pathway for an explosive detonator to be placed adjacent to the top circular layer of explosive material. The two circular layers of explosive material may also contain an opening along their central axes, providing a space for an explosive detonator to be placed between the circular layers of explosive material.

After the shaped charge tool is assembled, it is lowered into the tubular member. For optimal effectiveness, the circular shaped charges within the tool must be aligned at a substantially perpendicular angle, relative to the tubular wall. Following the placement of the shaped charge tool at the proper location within the tubular member, the shaped charge is detonated.

Once the charge is detonated, a shock wave propagates radially along the transverse plane between the circular half charges and collides with the V-shaped liner, forcing the two liner surfaces together at high speeds. The resulting impact between the two liner surfaces results in extreme pressure being generated. At these high pressures, the metal liner exhibits plastic and/or fluid-like characteristics. While the expanding shock wave folds the metal liner together into a disc shape, the shock wave continues to advance radially along the transverse plane, pushing and accelerating the liner material to flow radially along the transverse plane at extreme velocities, forming a jet of liner material able to cut through the tubular member.

Traditional fabrication procedures for circular shaped charge tools include independent fabrication of the half-liner pieces, each having a truncated cone shape, with an open base and apex surface. The circular explosive discs can be formed using half-liners as the outside wall portions of the mold. The apex surface of the explosive disc is formed against the bottom of a flat mold, the explosive material is packed into the area between the mold and the half-liner, then a top mold plate is pressed against the explosive material, solidifying and bonding the material with the half-liner. This method forms a circular disc of explosive material, with the half-liner outlining the radial walls of the disc. A unified disc of explosive material bonded with a half-liner is called a half-charge. To form the shaped charge tool, two half charges are placed apex-to-apex, in a cylindrical housing between two steel plates, as described above.

Another traditional fabrication procedure for making circular shaped charge tools includes forming the circular explosive disc without half-liners outlining the radial walls of the explosive disc. The explosive charge material is formed into a truncated cone shape by using a mold to shape every surface of the charge, including the outside wall surface. This fabrication technique results in the half-liner and the explosive material disc being separate components, which must later be arranged within a cylindrical housing.

A shaped charge assembly comprising two or more explosive charge members, such as half-charges, results in small areas of separation between such members, which allow for overrunning of the detonating shock front. As the shock wave propagates radially from the central detonation point, the areas of separation between explosive charge portions allow a shock front to travel through the empty area at faster velocities than through areas containing explosive material. This shock front collides with the center of the liner, along the transverse plane between the half-charges, before the main shock wave impacts the rest of the liner. Such non-uniform collision can cause the liner jet to scatter or to be deformed excessively at the center, as opposed to a desired compact liner jet moving in the radial direction.

In another traditional manufacturing process, the circular explosive discs are fabricated in several pieces, such as in quarters. These quarters are then arranged to form circular explosive discs when assembling the components in a cylindrical housing. A half charge may comprise four or more segments (e.g., wedge-shaped segments that together form a circle). Such an arrangement creates multiple areas of separation between the segments of explosive material, subject to the same difficulties present when using half-charges: as the shock wave propagates, the areas of separation provide empty pathways through which the shock front travels at faster velocities than through areas containing explosive material. This overrunning shock front collides with the liner in certain areas before the main shock wave impacts the rest of the liner, resulting in a non-uniform collision, causing the liner to be deformed and/or scattered excessively at points along the areas between adjacent segments of explosive material.

In addition to configurations that include multiple segments of explosive material, the space between two half liners, or between other configurations involving multiple liner pieces, also contributes to improper liner jet formation. As the shock wave impacts and collapses the V-shaped liner, the small space between the two half liners, or between other portions, allows the passage of expanding gasses into the standoff space, disrupting the formation of a uniform jet or slug. A deformed or non-symmetrical jet or slug reduces the penetrating efficiency of the shaped charge cutting tool.

Conventional tubular cutter tools typically incorporate explosive material sections that are relatively thick throughout (i.e. from the detonator to the liner). Other designs incorporate top and bottom housing plate surfaces that are sloped or that contain sharp edges or angles. Uneven plate surfaces can cause shock wave deflections in various directions within a thick layer of explosive material. Shock wave deflections may cause shock front overrunning along the path of deflection through the explosive material. This results in certain parts of the shock wave striking an area of the liner along the vertical plane before the main shock wave strikes the rest of the liner. A non-symmetrical collision causes the liner to be deformed unevenly, resulting in a non-symmetrical liner jet formation, thus reducing the effective penetration capabilities of the cutter and causing uneven severing of a tubular member. Shock wave deflections may also cause shock wave cross propagation, which occurs when shock waves having opposite directional component vectors collide and interfere with one another. Such shock wave collisions result in explosive energy loss, which also reduces the effective penetration capabilities of the cutter.

An energy loss due to separation between the upper and lower end plates prior to jet formation is also a common problem with many conventional shaped charge cutting tools. As the explosive material is detonated, explosive energy is released in all directions. If the area between the end plates expands prior to jet formation, energy is lost when deforming and accelerating these end plates, resulting in less energy available to be utilized toward liner jet formation.

Over years of experimentation, shaped charge cutter technology has developed extensively. Certain physical characteristics of shaped charge elements and certain relationships between those elements have been revealed as significant, even though prior understanding of the technology labeled them as unimportant. Departures from conventional methods, that may have previously been thought of as minute or insignificant, have led to unpredictable results, significant performance improvements, and reductions in material and fabrication costs.

A need exists for a shaped charge tubular cutter tool that overcomes the deficiencies of conventional cutters by preventing detonation front overrunning along the transverse plane between adjoining partial charges and between adjoining explosive material segments.

A further need exists for a shaped charge cutter tool that eliminates internal shock wave deflections, which can result in shock front overrunning and shock wave cross propagation.

A need also exists for a casing cutter tool that is highly efficient, utilizing more explosive energy into the cutting action than standard explosive tubular cutters.

SUMMARY

Embodiments usable within the scope of the present disclosure relate to an explosive cutter assembly comprising a housing assembly having an upper plate and a lower plate, wherein the upper and lower plates each comprise a flat surface positioned parallel relative to each other, a vertical surface extending in a transverse relationship to the flat surface, and a diagonal surface adjacent to the vertical surface. Embodiments of the cutter assembly can further comprise a circular liner having an upper diagonal liner section, a lower diagonal liner section, and a vertical liner section positioned between the upper and lower diagonal liner sections, wherein the circular liner comprises a single-piece construction. The cutter assembly can also comprise an explosive charge having a main charge and a detonation disc, wherein the main charge is positioned between the circular liner and the vertical and diagonal surfaces of the upper and lower plates, wherein the detonation disc is positioned between the flat surfaces of the upper and lower plates, and wherein the explosive charge comprises a single-piece construction.

In an embodiment of the explosive cutter assembly, the upper and lower diagonal liner sections can comprise truncated conical shapes, oriented apex to apex, and the vertical liner section can comprise a cylindrical shape. In an embodiment, the lengths of the upper and lower diagonal sections and the length of the vertical section can be equal or substantially equal.

In an embodiment, the main charge can adhere to the circular liner, and/or be compressed against the circular liner, for resulting in a physical bond therebetween. The main charge can include a vertical main charge section that can extend in a transverse relationship to the detonation disc; and in an embodiment, the main charge can include a diagonal main charge section that can extend from the vertical main charge section. In an embodiment, the main charge can be at least twice as thick as the detonation disc.

In an embodiment of the explosive cutter assembly, the upper and lower plates can comprise a thicker construction adjacent to the main charge and a thinner construction adjacent to the detonation disc. In an embodiment, the edges between the vertical surfaces and the flat surfaces of the upper and lower plates can be truncated. In an embodiment, the lower plate can extend about the outer surface of the circular liner to define a standoff space for formation of the liner jet.

Further embodiments usable within the scope of the present disclosure relate, generally, to an explosive cutter that can comprise an upper plate having an upper flat surface, a lower plate having a lower flat surface, wherein the upper and lower flat surfaces are facing each other and are parallel to each other. The explosive cutter can also comprise a liner having three liner sections connected to each other and oriented at selected angles relative to each other, wherein the liner comprises a unitary construction. The explosive cutter can also comprise an explosive charge having a main charge and a detonating charge. The main charge can include three main charge sections having a generally uniform thickness, which can be oriented at the selected angles relative to each other, and wherein the selected angles between the three liner sections and between the three main charge sections can be essentially the same. Also, the explosive charge can comprise a unitary construction, the main charge can adhere to the liner, and the detonating charge can comprise a generally flat configuration.

Another embodiment usable within the scope of the present disclosure relates to a detonator adapter configured for connection with an explosive cutting or perforating device. The detonator adapter can comprise a generally cylindrical body having at least one external threaded portion and an internal bore extending along the longitudinal axis thereof, wherein the internal bore can be configured to retain a detonator charge, a booster charge, a blasting cap, or combinations thereof. The generally cylindrical body can be configured to connect to a wireline, a cable, a tubular string, or other means for transporting the explosive cutter or perforating device within a tubular or other object to be severed. The detonator adapter can also comprise at least one threaded member connectable about the generally cylindrical body, wherein the lower threaded member can retain the generally cylindrical body in position within the explosive cutting or perforating device.

Other embodiments usable within the scope of the present disclosure relate to methods for forming a cut in a tubular object. More specifically, the methods can comprise the steps of positioning a cutting assembly relative to the tubular object, wherein the cutting assembly can comprise a liner comprising three sections integrally formed and oriented at different angles relative to each other. The cutting assembly can further comprise an explosive charge having a unitary construction comprising a first area of explosive material disposed adjacent to an inner surface of the liner and a second area of explosive material extending from the liner to the axial center of the cutting assembly. The steps of the method can include the step of providing a detonator in association with the second area of explosive material. Lastly, embodiments of the methods can comprise the step of actuating the detonator, thereby detonating the second area of explosive material which detonates the first area of explosive material, wherein detonation of the first area of explosive material can compress the liner and propel the liner toward a target to be cut.

BRIEF DESCRIPTION OF THE DRAWINGS

In the detailed description of various embodiments usable within the scope of the present disclosure, presented below, reference is made to the accompanying drawings, in which.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood that the drawings are intended to illustrate and plainly disclose presently preferred embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concepts herein taught, and because many modifications may be made in the embodiments described herein, it is to be understood that the details herein are to be interpreted as illustrative and non-limiting.

Figure 2:
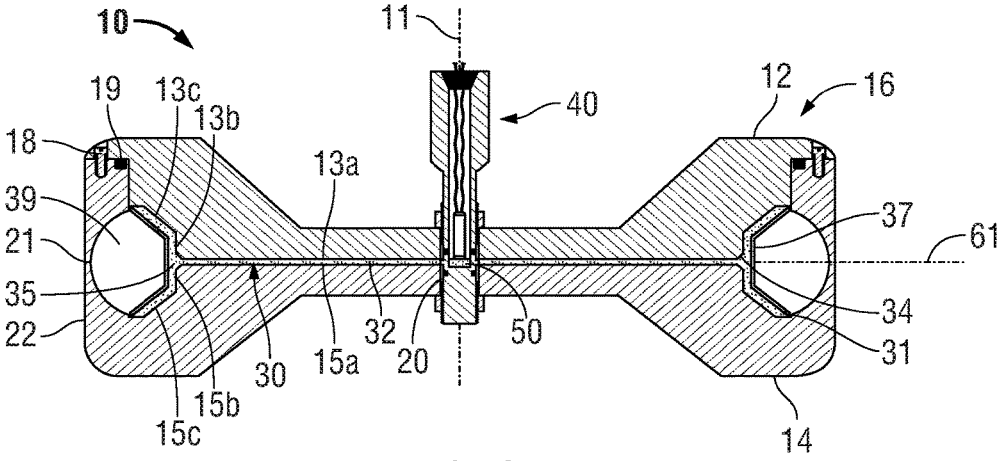
FIG. 2 depicts a cross-sectional side view of an embodiment of a tubular cutter usable within the scope of the present disclosure.

Referring initially to FIG. 2, a cross-sectional side view of an embodiment of a tubular cutter assembly (10), usable within the scope of the present disclosure, is shown. The depicted cutter assembly (10) includes an enclosure, specifically, a housing assembly (16), having a top housing plate (12) and a bottom housing plate (14). The top housing plate (12) is depicted having internal surfaces, namely a flat horizontal surface (13*a*), a vertical surface (13*b*) adjacent to the horizontal surface (13*a*), and a diagonal surface (13*c*) adjacent to the vertical surface (13*b*). As depicted, the bottom housing plate (14) can have internal surfaces, namely a flat horizontal surface (15*a*), a vertical surface (15*b*) adjacent to the horizontal surface (15*a*), and a diagonal surface (15*c*) adjacent to the vertical surface (15*b*). When the top housing plate (12) and the bottom housing plate (14) are assembled, as depicted in FIG. 2, the horizontal surfaces (13*a*, 15*a*) can be essentially parallel, forming a gap therebetween adapted to contain a detonation disc (32) of the shaped charge disc (30). The lengths of the surfaces (13*b*, 13*c*, 15*b*, 15*c*) and angles between the vertical surfaces (13*b*, 15*b*) and the diagonal surfaces (13*c*, 15*c*) depend on the configuration of the liner (37) and the main charge (35), wherein the vertical surfaces (13*b*, 15*b*) and the diagonal surfaces (13*c*, 15*c*) of the upper and lower housing plates (12, 14) are configured to abut the inner (e.g. convex) surface of the main charge (35).

Figure 1:
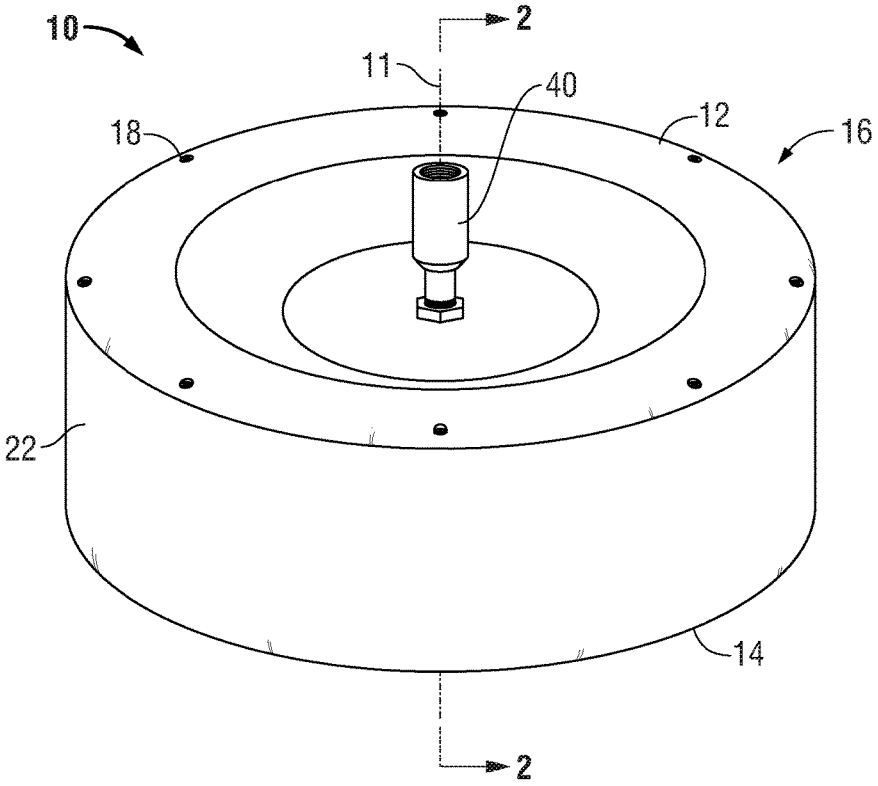
FIG. 1 depicts an isometric view of an embodiment of a tubular cutter usable within the scope of the present disclosure.

The exterior shape of the housing assembly (16) can be essentially cylindrical for enabling insertion into and passage through tubular members while permitting a minimal amount of water and/or debris in the annular space between the side surface (22) of the cutter assembly (10) and the inner surface of the tubular member. During insertion of the cutter assembly (10) into a tubular member and/or prior to detonation, the side surface (22) is positioned along or adjacent to the inner surface of the tubular member. FIG. 1 depicts an isometric view embodiment of a tubular assembly (10), showing the top housing plate (12) joined with the bottom housing assembly (14) to form a generally cylindrical housing assembly (16). FIG. 2 also depicts each housing plate (12, 14) comprising rounded outside corners, allowing the cutter assembly (10) to pass or be lowered through a tubular member while minimizing the chances of interference from or being hung up on foreign objects or debris located within the tubular member. However, it should be understood that housings and cutter assemblies having other shapes can be used without departing from the scope of the present disclosure.

During typical use, the presence of water, or other matter between the cutter assembly (10) and the inner surface of the tubular to be cut, is undesirable, as such material can act as impediments through which the liner must pass before contacting the tubular. Such impediments can result in a loss of energy, which can cause an incomplete or uneven severing of the tubular member. The top housing plate (12) and the bottom housing plate (14) are shown secured together by a plurality of screws (18) inserted through the top housing plate (12) and threaded into the bottom housing plate (14), however, other methods of connection are also usable, including welding, force and/or interference fits, other types of connectors and/or fasteners, or integral formation of the housing assembly (16) as a single component. An O-ring (19) or similar sealing element can be used between the top and bottom housing plates (12, 14), to prevent fluids and/or other contaminants from entering the interior of the housing assembly (16).

Figure 3:
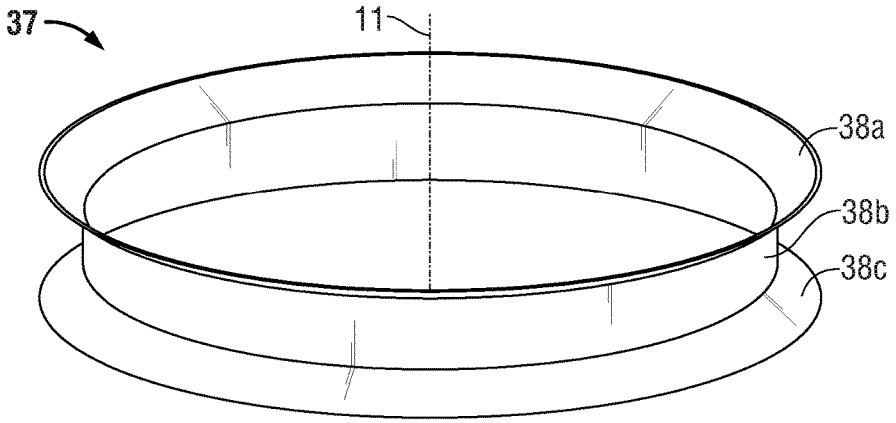
FIG. 3 depicts an isometric view of an embodiment of a liner usable within the scope of the present disclosure.
Figure 4:
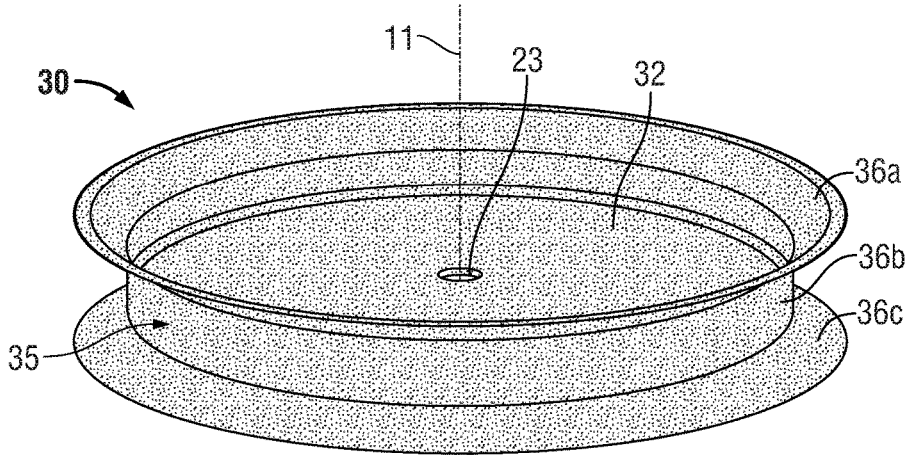
FIG. 4 depicts an isometric view of an embodiment of a shaped charge disc usable within the scope of the present disclosure.
Figure 5:
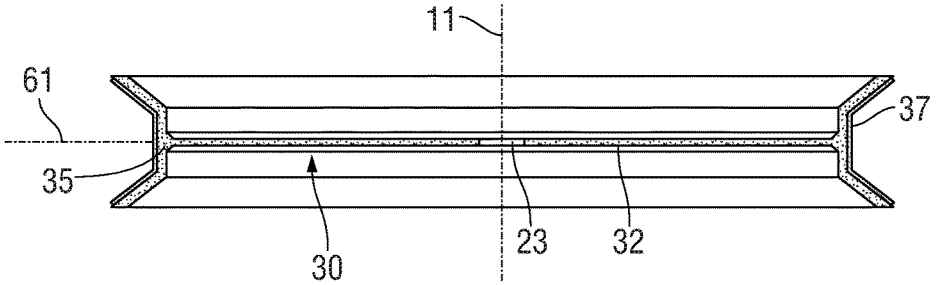
FIG. 5 depicts a cross-sectional side view of an embodiment of a liner and a shaped charge disc usable within the scope of the present disclosure.

Reference now to FIGS. 3-5, depicting the shaped charge disc (30) and liner (37). The shaped charge disc (30) includes a main charge (35), comprising a thicker area of explosive material, which is in contact with the inner surface of a truncated liner (37), wherein the inner surface is also the convex surface of the truncated liner (37). The main charge (35) depicted in FIG. 4, comprises three sections, which are the vertical section (36*b*), the upper diagonal section (36*a*) extending from the top side of the vertical section (36*b*), and the lower diagonal section (36*c*) extending from the bottom side of the vertical section (36*b*). As further depicted in FIGS. 4 and 5, the upper and the lower diagonal sections (36*a*, 36*c*) can extend diagonally from the vertical section (36*b*). The shaped charge disc (30) can include a radial detonation disc (32), which can comprise a thinner area of explosive material and which can extend from the axial center (11) of the shaped charge disc (30) to the center of the vertical section (36*b*) of the main charge (35). FIGS. 4 and 5 depict the vertical section (36*b*) and the diagonal sections (36*a*, 36*c*) having approximately the same length, wherein the upper and lower diagonal sections (36*a*, 36*c*) extend at angles of approximately 45 degrees away from the transverse plane (61). However, it should be understood that the relative lengths and angles of the three sections (36*a*, 36*b*, 36*c*) of the main charge (35) depend on the specific configuration of the liner (37), wherein the three sections (36*a*, 36*b*, 36*c*) of the main charge (35) abut the corresponding three sections (38*a*, 38*b*, 38*c*) of the liner (37), as depicted in FIGS. 2 and 4.

It should be understood that while the description herein refers to the main charge (35) and the radial detonation disc (32) separately, they can be integrally formed and/or connected; therefore, references to discrete areas of explosive material are primarily conceptual and used to illustrate the structure and the functionality of different portions of the shaped charge disc (30). Embodiments of the shaped charged disc (30) usable within the scope of the present disclosure can include a continuous unitary body of explosive material, with no physical separation between the described first and second areas of explosive material. As such, FIGS. 2 and 5 depict the radial detonation disc (32) as a thin, uniform, single-piece disc of explosive material, tightly fitted between the top and bottom housing plates (12, 14). The outer diameter of the radial detonation disc (32) terminates at the main charge (35), which uniformly overlays the entire convex surface of the liner (37). The relative thickness and/or other dimensions of the main charge (35) can vary depending on the intended application of the cutter (10) (e.g., the thickness of the tubular to be cut), but generally, the quantity of explosive material within the main charge (35) will be sufficient to deform and accelerate the liner (37) to a velocity necessary to sever a target tubular member. The explosive material used to form the shaped charge disc (30) can include a measured quantity of powdered explosive material such as RDX or HMX.

Referring now to FIGS. 3 and 5, an embodiment of a liner (37) is depicted. FIGS. 3 and 5 show the liner (37) comprising a thin generally circular sleeve having a diameter that is greater than its height. The liner (37) depicted in FIGS. 3 and 5 comprise three sections, which are the vertical section (38*b*), the upper diagonal section (38*a*) extending from the top side of the vertical section (38*b*), and the lower diagonal section (38*c*) extending from the bottom side of the vertical section (38*b*). As further depicted, the upper and the lower diagonal sections (38*a*, 38*c*) can extend diagonally from the vertical section (38*b*) at essentially the same angles as the upper and the lower diagonal sections (36*a*, 36*c*), of the main charge (35), extend from the vertical section (36*b*) of the main charge (35). The inner or the convex surface of the liner (37) is overlaid by the main charge (35) of the shaped charge disc (30).

In FIG. 2, the shaped charge disc (30) is shown aligned, coaxially, with the axial center (11), and positioned between the top and bottom housing plates (12, 14). When the shaped charge disc (30) is positioned within the housing assembly (16), a standoff space (39) remains between the liner (37) and the inner surface (21) of the housing assembly (16). The presence of the standoff space (39) positions the liner (37) at a sufficient distance from the item to be cut (e.g., a tubular member), allowing the liner (37) to collapse and accelerate to form a jet, following detonation of the main charge (35). While the inner surface (21) of the housing assembly (16) is shown having a rounded and/or semicircular cross-sectional profile, it should be understood that a standoff space, having any shape, can be used without departing from the scope of the present disclosure.

As further depicted in FIG. 2, proper positioning of the liner (37) and the shaped charge disc, can be facilitated through use of an edge (31) (e.g., a depression, shoulder, divot, etc.) within the housing assembly (16), the edge (31) being located such that when the liner (37) is placed in contact therewith, the liner (37) is positioned a suitable distance from the inner surface (21) of the housing assembly (16) to form the standoff space. Contact between the edge (31) and the liner (37) can prevent undesired movement of the liner (37) within the housing.

Conventional designs of explosive cutting tools (not shown) do not incorporate a thin radial detonation disc (32), as depicted in FIGS. 2 and 5, but instead, comprise areas of explosive material having substantial thickness throughout (i.e. ranging from a central detonator to the liner). Conversely, the shape of the depicted radial detonation disc (32) allows for propagation of the detonation originating from a centrally located detonator (40), wherein the shock front travels radially along the transverse plane (61), detonating all portions of the main charge (35) at substantially the same time. Specifically, the small amount of explosive forming the thin radial detonation disc (32) allows uniform and symmetrical detonation propagation from the detonator (40) to the main charge (35) without perturbation of the shock front experienced with thicker shaped charged discs. As the shock front reaches the main charge (35), it detonates the main charge uniformly and symmetrically, whereby the explosive energy from the main charge folds and accelerates the liner (37). Furthermore, detonation of a radial detonation disc having a thicker conventional design results in substantial amount of explosive energy being directed along the axial direction (e.g. parallel to central axis of the cutting tool) against the top and bottom housing plates. However, in the depicted embodiment of the current tubular cutter (10), more of the explosive material is located in the main charge (35) section located on the side of the housing assembly (16), instead of between the housing plates (12, 14). Specifically, the main charge (35) is located adjacent to the vertical walls (13*b*, 15*b*) of the housing plates (12, 14), whereby more energy is directed sideways to accelerate the liner (37) along the transverse plane (61). In the conventional designs, a larger percentage of the explosive material is located between the housing plates closer to the axial center of the cutter, which results in more explosive energy being directed vertically, along the axial direction, to separate the housing plates.

Furthermore, conventional designs (not shown) also typically include top and bottom housing plate surfaces that are sloped or that contain sharp edges or angles, which disturb the shock front and the uniform and symmetrical detonation propagation. As depicted in FIG. 2, when assembled together, the top and the bottom housing plates (12, 14) define a straight flat space between the flat horizontal surfaces (13*a*, 15*a*) of the top and bottom housing plates (12, 14), allowing the shock front to propagate uniformly in the direction parallel to the transverse plane (61). Also, the flat horizontal surfaces (13*a*, 15*a*) of the top and the bottom housing plates (12, 14) are machined smooth to allow the proper application of the shaped charge disc (30) to the housing surfaces and to not allow any air gaps between the shaped charge disc (30) and the horizontal surfaces (13*a*, 15*a*) of the housing plates (12, 14).

During cutter operation (e.g. detonation), the penetration of the target and pressure fracture is improved when uniform, homogenous jet formation is possible. The embodiment of the radial detonation disc (32), depicted in FIGS. 2 and 5, can provide buffering and eliminate shock wave cross propagation due in part to its thin and uniform shape, which does not permit shock front overrunning along the horizontal surfaces (13*a*, 15*a*) of either housing plate (12, 14). Because the radial detonation disc (32) is thin, there exists insufficient space for the shock front to significantly overrun the main shock wave at any level of the vertical plane within the radial detonation disc (32). Furthermore, the lack of edges or angles along the horizontal surfaces (13*a*, 15*a*) and the radial detonation disc (32) prevents shock wave deflections, which can result in shock wave collisions and loss of energy. Thus, the shock wave can propagate symmetrically through the radial detonation disc (32), reaching and detonating all portions of the main charge (35) at substantially the same instant. A single-piece configuration also prevents detonation front overrunning along the transverse plane (61) between the adjoining half charges, as is typical of conventional designs. A single-piece configuration also prevents the "spoked wheel" effect, where the shock front overruns the main shock wave along the vertical spaces between multiple adjoining explosive disc segments.

Furthermore, a single-piece liner also prevents shock wave overrunning into the standoff space (39) before the liner (37) is collapsed. As the shock wave impacts a conventional V-shaped liner, a small space between the two half liners can allow the passage of expanding gasses into the standoff space, disrupting the formation of a uniform jet or slug. As shown in FIGS. 2 and 3, a single-piece liner (37), which does not have spaces between any of its three sections (38*a*, 38*b*, 38*c*), does not allow the passage of gasses into the standoff space (39), thus allowing jet formation to remain uninterrupted, resulting in a uniform and symmetrical jet. Thus, a single-piece shaped charge disc (30) has significant advantages over a conventional explosive shaped charge assembly comprising two half-liners or multiple segments of explosive material.

As described above, conventional shaped charge assemblies (not shown) can be constructed using two half charges, assembled apex-to-apex. Other conventional designs can include explosive material that is further segmented into multiple parts. An assembly of two or more explosive charge members can create thin areas of separation between such members, which provide a path for expanding gasses to overrun the main detonating shock front. Conversely, the shaped charge disc (30), depicted in the embodiment of the cutting tool (10) shown in FIGS. 2 and 5, includes a single-piece shaped charge disc (30) positioned in direct contact with a single-piece liner (37). For example, embodiments of the present cutter assembly (10) can be formed by first mechanically forming the truncated liner (37), having a desired shape and diameter, centering the liner (37) in a press mold fixture, filling the liner (37) with a precisely measured quantity of powdered explosive material that is distributed within the internal cavity of the mold against the interior surface of the liner (37), and then lowering a press mold to apply compression pressure to the explosive powder and liner (37), thereby forming the shape of the shaped charge disc (30) and bonding the explosive material and liner (37) into a single assembly. A detonator aperture (23) may be formed at the axial center (11) of the radial detonation disc (32), for example, by incorporating the aperture shape into the mold or by machining or otherwise modifying the assembly during or after formation of the shaped charge (30)/liner (37) assembly.

FIGS. 2 and 4 further depict a truncated edge or a chamfer (34) formed at the edges of the horizontal surfaces (13*a*, 15*a*) of the top and bottom plates (12, 14). While a single-piece shaped charge disc (30) can enable a detonation shock wave to reach the main charge (35) at the same time, the entire main charge (35) may not detonate at substantially the same time if the shock front slows down. As the shock wave propagates through the radial detonation disc (32) along the transverse plane (61), a sharp turn in the shape of the explosive material, such as the intersection between the shaped charge disc (30) and the main charge (35) areas, can slow down the speed of the shock front. If the vertical section (36*b*) of the main charge (35), located adjacent to the radial detonation disc (32), detonates a significant amount of time before the upper and lower diagonal sections (36*a*, 36*c*) of the main charge (35), the liner jet can form improperly. However, the chamfer (34) can enable the shock wave to turn more smoothly and to propagate more quickly away from the transverse plane (61), thereby facilitating a faster and essentially a simultaneous detonation of all portions of the main charge (35).

As depicted in FIGS. 2 and 3, the shape of the truncated liner (37) can also facilitate functionality of the tubular cutter (10). A conventional liner is a thin strip of metal, having the shape of two truncated cones attached at their apex. A liner (37) within the scope of the present disclosure departs from a conventional V-shaped cross section by including an additional vertical section (38*b*) (e.g. cylindrical section) between two diagonal sections (38*a*, 38*c*) (e.g. truncated cones). By adding a vertical section, the liner (37) is elongated, providing additional quantity of material to the liner (37), which can provide greater penetration capability. FIG. 3 depicts a liner (37) having a truncated V cross-sectional shape, having three sections (38*a*, 38*b*, 38*c*) of approximately the same length, wherein the upper and lower diagonal sections (38*a*, 38*c*) extend at angles of approximately 45 degrees away from the transverse plane (61). However, it should be understood that the relative lengths and angles of the liner (37) sections can be varied depending on the specific tubular member to be cut, expected wellbore conditions, and other similar factors. In alternate embodiments, the liner (37) can be formed from a copper and/or lead alloy having the upper and lower diagonal sections (38*a*, 38*c*) oriented at angles ranging between 30 to 60 degrees away from the transverse plane (61). The overall height and thickness of the liner (37) can be determined by the cutting application. The truncated liner (37) design in conjunction with the shape of the housing (16), allow the liner (37) and the main charge (35) to be scalable, therefore the relative size and configuration of individual components of the cutter (10) can remain the same, while the overall size of the cutter (10) and the individual components can increase or decrease as the cutter (10) is used to sever larger or smaller tubulars.

Figure 6:
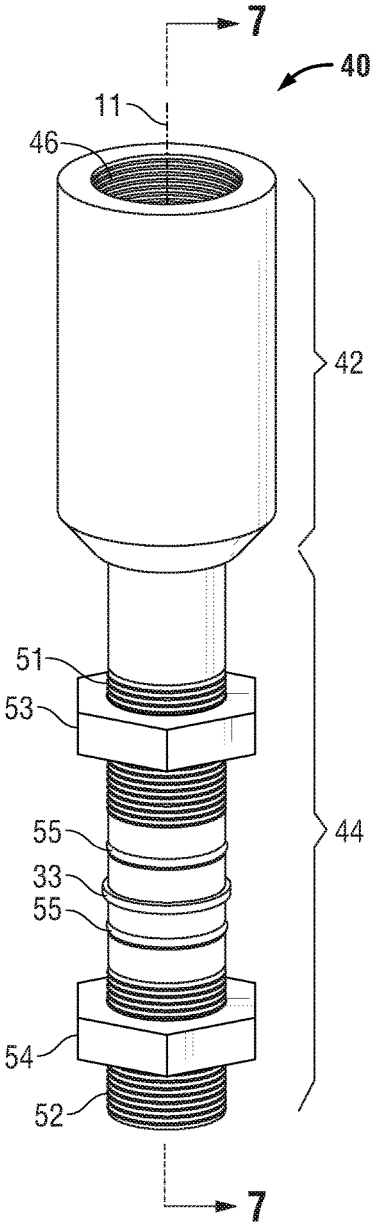
FIG. 6 depicts an isometric view of an embodiment of an adaptor sub usable within the scope of the present disclosure.
Figure 7:
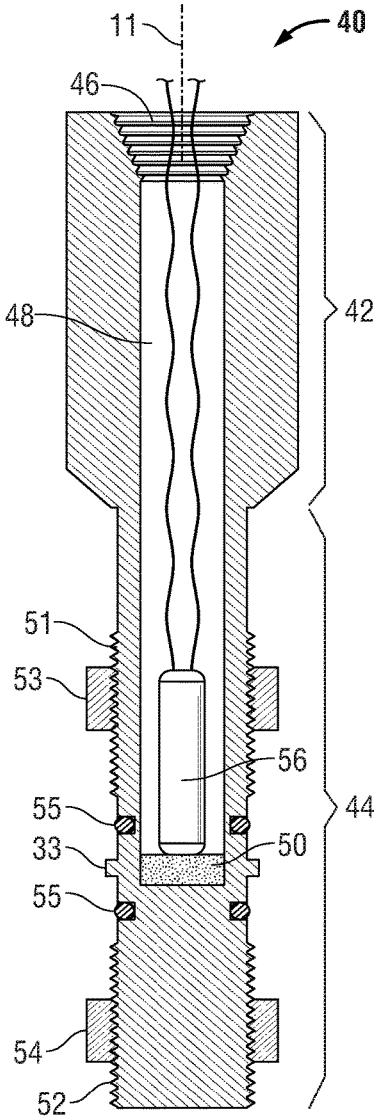
FIG. 7 depicts a cross-sectional side view of an embodiment of an adapter sub usable within the scope of the present disclosure.

FIGS. 1 and 2 further depict an embodiment of the tubular cutting assembly (10) having an adaptor sub (40) disposed therein (e.g., inserted through the housing assembly (16) and/or otherwise attached thereto). FIGS. 6 and 7 depict an isometric and a cross-sectional side view of an embodiment of the adaptor sub (40). Specifically, FIGS. 6 and 7 depict the adaptor sub (40) having an elongated and essentially cylindrical configuration, comprising an adaptor head section (42) and an adaptor insert section (44). The head section (42) of the adaptor sub (40) is shown having an internal bore (48) extending longitudinally through the head section (42) and a portion of the insert section (44) to accommodate a detonation wafer (50), which can, in an embodiment, be installed through the bore (48). The top end of the adaptor head (42) is shown having an internal threaded port (46), usable for attachment to a conduit, a wireline, or other device usable to lower and/or suspend the adaptor sub (40) within a wellbore. The depicted embodiment of the insert section (44) has a bulkhead connector configuration, comprising a first male thread (51) section located on the upper portion of the adaptor insert (44) and a second male thread (52) section located on the lower portion of the adaptor insert (44). The threads (51, 52) are engaged by removable threaded nuts (53, 54). As such, the depicted adaptor sub (40) is a removable component, which can be inserted into the throughbore (20) of the housing assembly (16) prior to positioning the tubular cutter (10) within a well and/or prior to detonation of the tubular cutter (10).

As shown in FIGS. 2 and 7, the insert section (44) can be inserted through the housing throughbore (20), such that the lower male threads (52) are exposed and protruding past the lower housing plate (14). The lower threaded nut (54) can be used to engage the lower male threads (52) and secure the adaptor sub (40) to the housing assembly (16). In the embodiment of the adaptor sub (10) depicted in FIGS. 2 and 7, the upper threaded nut (53) can be threadedly engaged with the upper male threads (51) prior to introducing the insert section (44) into the housing throughbore (20). Such configuration allows the upper nut (53) to be tightened against the top housing plate (12) to further secure the adaptor sub (40) with the housing assembly (16). The two threaded nuts (53, 54) allow the adaptor sub (40) to be secured to the housing assembly (16) at a desired vertical position, enabling the detonator (50) to be positioned in the detonator aperture (23, see FIG. 5) located at the center of the radial detonation disc (32). FIGS. 2 and 7 also depict a set of O-ring seals (55) positioned about the insert section (44) of the adaptor sub (40). The O-rings (55) create a fluid seal between the adaptor sub (40) and the housing assembly (16), preventing water or other contaminants from entering the housing assembly (16).

In another embodiment (not shown) of the adaptor sub (40), the threaded portion may cover all or most of the external surface of the adaptor insert section (44), allowing the upper and lower threaded nuts (53, 54) to engage the threaded portion along most or the entire length of the insert section (44). In still another embodiment (not shown), the adaptor sub (40) can comprise a single threaded nut (54) engaging the lower male thread (52). In the embodiment, the housing assembly (16) can be retained between the adaptor head section (42) and the lower threaded nut (54), which can be tightened against the bottom housing plate (14). Although FIGS. 6 and 7 depict two O-ring seals (55) positioned about the central part of the insert section (44), the seals may also be placed around the housing throughbore (20), between the upper nut (53) and the top housing plate (12) and/or between the lower nut (54) and the bottom housing plate (14), creating a seal between said components to prevent water or other contaminates from entering the inside of the housing assembly (16).

The adaptor sub (40), depicted in FIGS. 2 and 7, can be usable to house the detonator wafer (50) and to connect the cutter assembly (10) to a wireline or a similar conduit (not shown), usable to lower the cutter (10) into a well or other tubular members (not shown) during operation. Although FIG. 7 depicts an internal threaded port (46) as the means for said connection, alternatively, any means known in the art for connecting the adaptor sub (40) to a device usable to lower the adaptor sub (40) in a wellbore or another tubular, can be used. The adaptor sub (40), depicted in FIGS. 2 and 7, can be configured to house a booster charge or a detonator wafer (50) and/or a blasting cap (56), which can be used to detonate the detonator wafer (50) within the adaptor bore (48) of the insert section (44). Proper placement of the detonator (50) at the center of the shaped charge disc (30), as shown in FIG. 2, can be achieved by securing the adaptor sub (40) against the housing assembly (16) with the threaded nuts (53, 54) as the detonator (50) is positioned at a desired location. The insert section (44), as depicted in FIGS. 6 and 7, is further shown having a detonation disc spacer (33) formed thereon, proximate to the location of the detonator (50), usable to ensure proper positioning of the detonator (50) relative to the explosive material. However, other embodiments of the cutter assembly (10) may not include a spacer (33).

Although the adaptor sub (40), depicted in FIGS. 1 and 2, is shown inserted into housing assembly (16) and being used to detonate a shaped charge disc (30), the adaptor sub (40) can be used to detonate other explosive devices, such as perforators (not shown). While being used with a perforator, the adaptor sub (40) may be used to place one or more detonation boosters or blasting caps at precise locations adjacent to one or more charges usable to cut or perforate a target. In alternate embodiments, the adaptor sub (40) may comprise longer geometry, having a longer head (42) and/or insert (44) sections, allowing connection with multiple explosive cutters or perforators. The longer geometry will also allow an adaptor sub to be used with thicker explosive cutters or perforators.

In addition to the screws (18), shown in FIGS. 1 and 2, the adaptor sub (40) can assist in securing the upper and lower housing plates (12, 14) together by compressing the plates (12, 14) by one or more connecting nuts (53, 54). Prior to and during the detonation of the detonator (50), the adaptor sub (40) can add additional structural support to the housing assembly (16) to delay, reduce, and/or prevent separation of the housing plates (12, 14). Housing plate separation, especially separation prior to formation of the liner jet, can cause a loss of explosive energy generated by the shaped charge (30), as the energy used to accelerate the housing plates (12, 14) away from each other is not used to collapse and/or accelerate the liner (37) sideways along the transverse plane (61).

Embodiments of the present cutter assembly (10) thereby incorporate features that provide enhanced energy efficiency, thus enhanced cutting efficacy. For example, the embodiment depicted and described above achieves a superior cut when compared to conventional devices, while effectively using up to 70% or more of the explosive energy generated, thus enabling less explosive material to be used in some embodiments. Embodiments described herein further prevent detonation front overrunning, shock wave deflections, and shock wave cross propagation common to conventional alternatives.

While various embodiments usable within the scope of the present disclosure have been described with emphasis, it should be understood that within the scope of the appended claims, the present invention can be practiced other than as specifically described herein.

What is claimed is:

1. A detonator adapter configured for connection with an explosive cutting or perforating device, the detonator adapter comprising:

a generally cylindrical body comprising at least one external threaded portion and an internal bore extending along the longitudinal axis thereof, wherein the internal bore is configured to retain a detonator charge, a booster charge, a blasting cap, or combinations thereof, wherein the generally cylindrical body is configured to connect to a wireline, a cable, or a tubular string transporting the explosive cutter or perforating device within a tubular or other object to be severed; and at least one threaded member connectable about the generally cylindrical body, wherein the at least one threaded member is external to the explosive cutting or perforating device and retains the generally cylindrical body in position within the explosive cutting or perforating device.

2. The detonator adapter of claim 1, wherein the at least one threaded member comprises an upper threaded member external to a top side of the explosive cutting or perforating device and a lower threaded member external to a bottom side of the explosive cutting or perforating device, configured to adjustably maintain the detonator adapter in selected position relative to the explosive cutting or perforating device.

3. The detonator adapter of claim 2, wherein the at least one external threaded portion comprises an upper external threaded portion and a lower external threaded portion, wherein the upper threaded member engages the upper external threaded portion, wherein the lower threaded member engages the lower external threaded portion.

* * * * *